United States Patent [19]

McMillin

[11] Patent Number: 4,708,827

[45] Date of Patent: Nov. 24, 1987

[54] METHOD OF AND APPARATUS FOR MAKING AND DISPENSING CARBONATED WATER WITH A DOUBLE DIAPHRAGM PNEUMATIC WATER PUMP

[75] Inventor: John R. McMillin, Maplewood, Minn.

[73] Assignee: The Cornelius Company, Anoka, Minn.

[21] Appl. No.: 840,230

[22] Filed: Mar. 17, 1986

[51] Int. Cl.[4] ..... B01F 3/04

[52] U.S. Cl. ..... 261/35; 99/323.1; 261/64.3; 261/158; 261/DIG. 7; 417/393; 417/395; 426/477

[58] Field of Search ..... 261/35, 64.3, 158–161, 261/DIG. 7; 426/474, 477; 417/393, 395, 559, 563, 562, 568; 91/307, 329, 346, 347, 341 A; 99/275, 323.1; 222/129.1, 145

[56] References Cited

U.S. PATENT DOCUMENTS

| | | | |
|---|---|---|---|
| 3,338,171 | 8/1967 | Conklin et al. | 417/395 X |
| 3,741,689 | 6/1973 | Rupp | 417/393 |
| 3,782,863 | 1/1974 | Rupp | 91/329 X |
| 3,838,946 | 10/1974 | Schall | 417/393 X |
| 4,123,204 | 10/1978 | Scholle | 417/395 X |
| 4,304,736 | 12/1981 | McMillin et al. | 261/35 |
| 4,310,025 | 1/1982 | Tracy | 137/625.48 |
| 4,354,806 | 10/1982 | McMillin et al. | 417/393 |
| 4,386,888 | 6/1983 | Verley | 417/395 X |
| 4,436,493 | 3/1984 | Credle, Jr. | 91/347 X |
| 4,478,560 | 10/1984 | Rupp | 417/393 |

*Primary Examiner*—Richard L. Chiesa
*Attorney, Agent, or Firm*—Henry C. Kovar

[57] ABSTRACT

A method of and apparatus for making and dispensing carbonated water with a double diaphragm continuous delivery pneumatic liquid pump has a water pressure regulator on a water inlet line to the pump, a water fill line to a carbonator, a propellent exhaust line from the pump to the carbonator, a carbon dioxide line to the carbonator, and a gas pressure regulator for controlling the storage pressure in the carbonator and the exhaust back pressure in the pump propellent outlet, the exhaust back pressure is kept higher than the water pressure at the pump preventing diaphragm inversion; the method has the steps of dropping water pressure into the pump to below carbonation pressure, and maintaining the carbonation pressure on the pump diaphragm preventing inversion.

A method of and apparatus for boosting water pressure using the aforesaid pump wherein the pump boosted water pressure at its maximum is equal to a pneumatic propellent pressure minus a propellent exhaust back pressure plus a water supply pressure, wherein structure connected to the pump exhaust and the pump water outlet maintains a water inlet pressure less than the exhaust back pressure preventing diaphragm inversion in the pump.

29 Claims, 2 Drawing Figures

METHOD OF AND APPARATUS FOR MAKING AND DISPENSING CARBONATED WATER WITH A DOUBLE DIAPHRAGM PNEUMATIC WATER PUMP

BACKGROUND OF THE INVENTION

1. Field of the Invention

This invention pertains to a method of and apparatus for making and dispensing carbonated water with a double diaphragm continuous delivery pneumatically powered water pump, wherein gas pressure in excess of a reduced water supply pressure, is kept upon the diaphragms preventing diaphragm inversion.

This invention also pertains to a method of and apparatus for boosting water pressure with a double diaphragm pneumatic pump wherein a propellent exhaust gas back pressure on the diaphragms is kept higher than a water supply pressure for preventing diaphragm inversion.

2. Description of the Prior Art

The most relevant prior art is documented in J. R. McMillin et al U.S. Pat. No. 4,304,736 of Dec. 8, 1981. This patent documents a complete soft drink beverage dispensing system of the post-mix type having pneumatic syrup pumps and a double piston continuous delivery pneumatic water pump for delivering either tap or un-pressurized water to a carbonator vessel. The double piston pump in this dispenser is the specific subject matter of J. R. McMillin et al U.S. Pat. No. 4,354,806 and this pump has a control valve which is the specific subject matter of G. A. Tracy U.S. Pat. No. 4,310,025. Reference may be had to these patents for an extensive history of the prior art leading up to the development of the pneumatically powerable dispensing system of U.S. Pat. No. 4,304,736. This dispenser and its componentry have been tremendously successful and represent the world's first extensively successful soft drink dispenser using syrup in bag-in-box (BIB) packaging. This dispenser is in extensive use in the U.S., Australia, Spain, Italy and elsewhere, and it produces and dispenses a high quality soft drink beverage.

The problems that have developed with the dispenser according to U.S. Pat. No. 4,304,736 have to do with relatively high cost, complexity, gas usage, large size, and maintenance. These problems manifest themselves primarily in the double piston water pump. The double piston pump requires pistons, piston rings, shaft seals, stainless steel cylinders, discrete inboard and outboard cylinder heads, and quite large tie rods to hold it together. It is quite complex and has a great many precision and expensive parts. An extra quantity of propellent gas is consumed to overcome the frictional losses incurred by the piston rings. The pump is quite large with all its discrete parts and large tie rods, and it takes up a lot of room inside of the dispenser. The double piston pump requires a fair amount of relatively sophisticated maintenance with periodic replacement of piston rings and seals, tightening and/or replacement of the many propellent gas lines, and lubrication. The wrong type of lubrication will effectively contaminate the water and cause decarbonation and foaming upon dispensing. If the piston rings leak, blown by water is also exhausted by the control valve and the valve may tend to freeze up as the propellent gas pressure drops and the water leakage is exhausted.

Much interest has been focused upon the development of a double diaphragm continuous delivery syrup pump to replace the single action diaphragm syrup pump in the dispenser of U.S. Pat. No. 4,304,736. A specific example of a commercially successful double diaphragm syrup pump is documented in W. S. Credle, U.S. Pat. No. 4,436,493 of Mar. 13, 1984. The reader is referred to the extensive cited reference list of U.S. Pat. No. 4,436,493 for further examples of prior pumps and componentry. Functionally similar double diaphragm pumps are available under the names McCann, Bellofram, Flojet, Shurflow, Wilden, Rupp, ITT and others. Another pump of this type is in W. R. Scholle U.S. Pat. No. 4,123,204. The pump of Credle U.S. Pat. No. 4,436,493 has a cost which is about ½ of the cost of the pump of McMillin et al U.S. Pat. No. 4,354,806. Serious efforts have been made to try and make the Credle pump work in the dispenser of U.S. Pat. No. 4,304,736 but all efforts to date have failed.

The reason for the failures is that the diaphragms fail and wear and burst from inversion of the diaphragms due to the unpredictable pressure of the water supply. The double piston water pump will draw water under partial vacuum, or positively take and displace pressurized water. It makes no difference whether the water supply is pressurized or not because the piston rings seal both ways, specifically under pressure or vacuum and to either side of the rings. The double diaphragm pump has never been able to do this and it must be constructed to pull under vacuum only. In a double cylinder pump, one side is being pressurized while the other side is exhausting. The pump diaphragms are normally biased toward the liquid side by the pressure on the gas side or by the partial vacuum on the liquid side. During the exhaust cycle, this propellent pressure is removed from the diaphragm and the diaphragm is biased by this partial vacuum on the liquid side. In the power or pumping cycle, the diaphragm is biased into the liquid by the propellent pressure.

However, if an automatic pressurized source of water such as a municipal water line or an automatic well system is connected to the pump, upon the start of the exhaust and refill cycle the diaphragm is forced into the gas chamber by the water pressure and inversion of the diaphragm takes place. When the pumping cycle again starts, the diaphragm is blown back into the syrup chamber by the propellent pressure and reversion of the diaphragm takes place. In the drawings, on FIG. 2, side R shows the normal configuration of the diaphragm during propellent pressurization and pumping, and side I shows inversion of the diaphragm due to source water pressure.

Needless to say, continued inversion, reversion, inversion, reversion and so on of the diaphragm leads to its early and premature failure. All sorts of bizarre events occur upon perforation of the diaphragm. Water is free to get into the gas system, and gas, such as $CO_2$, can be fed into the water lines and start copper sulfate production. The beverage dispenser is also put out of order.

It is necessary to boost water pressure in order to carbonate the water. An ambient temperature carbonator requires about 100 PSIG water pressure and a cold carbonator requires about 30 PSIG water pressure for attaining the industry standard of 4.5 volumes of carbonation.

The existing booster systems are primarily electric and utilize a motor driven pump of some type. The most extensively commercialized water booster vane pump is a carbon sliding pump made by Procon and powered by an electric motor under the control of a relay. These are expensive, but are accepted and extensively used. Electric vibrator water pumps are used in very low volume dispensers. Some dispensers have dropped the gas pressure in the carbonator to let water in. Booth, Inc. has made most of these examples. The only successful pneumatic water pressure booster has been the double piston pump of J. R. McMillin et al U.S. Pat. No. 4,304,736. No party has been successful in boosting water pressure with a diaphragm pump. A low cost highly reliable and simple pneumatic water pressure booster would be very usable in ice cooled beverage equipment, at special events where electricity is not available and for many other presently unrecognized uses.

OBJECTS OF THE INVENTION

It is an object of the present invention to provide a new and improved method of making and dispensing carbonated water wherein a double diaphragm liquid pump is utilized for pumping water without diaphragm inversion.

It is an object of the present invention to provide a new and improved apparatus for making and dispensing carbonated water with a double diaphragm pnuematically powered pump that will function without diaphragm inversion.

It is an object of the present invention to provide a new and improved method of and/or apparatus for boosting water pressure having new steps and structure for preventing diaphragm inversion in the pneumatic pump.

SUMMARY OF THE INVENTION

A method of pneumatically making and dispensing carbonated water has the steps of connecting a double diaphragm continuous delivery liquid pump to an automatic bulk water source, regulating a carbonation pressure in a carbonator, providing to the pump a propellent gas pressure which is significantly higher than the carbonation pressure, pumping water to the carbonator with the propellent pressure, backing up used propellent gas in an outlet of the pump and maintaining an exhaust back pressure in the pump and on the diaphragms, dropping water source pressure to a water supply pressure at the pump liquid inlet with the water supply pressure being less than the exhaust back pressure, and preventing diaphragm inversion in the pump by keeping a gas pressure on the diaphragm which is always higher than the water supply pressure.

Apparatus for making and dispensing carbonated water with a double diaphragm continuous delivery pump, having a carbonation pressure, a water fill line from the pump to the carbonator, a propellent gas line to the pump at a pressure significantly higher than the carbonation pressure, structure on a used propellent exhaust of the pump for backing up an exhaust back pressure into the pump and on to the diaphragm, and a regulator in the water line set to provide a water supply pressure into the pump liquid inlet with the water supply pressure being less than the propellent exhaust back pressure.

A method of boosting water pressure with a double diaphragm continuous delivery pneumatic pump has the steps of providing propellent gas alternatively to each diaphragm of the pump, boosting water pressure to close to the propellent pressure, exhausting used propellent gas and backing up the exhausted gas at an exhaust gas pressure, reducing bulk water source pressure to a water supply inlet pressure which is less than the exhaust back pressure, maintaining the exhaust back pressure alternatively upon the diaphragm which is not subjected to the propellent pressure and preventing diaphragm inversion in the pump by keeping a gas pressure upon the diaphragm which is always higher than the water supply pressure.

Apparatus for boosting water pressure with a double diaphragm continuous delivery pneumatic pump has structure for supplying water to a liquid inlet of the pump at a pre-determined water supply pressure, structure for providing propellent gas at a propellent pressure to the pump, and structure in the propellent exhaust of the pump for backing up an exhaust pressure which is higher than the supply pressure, for preventing diaphragm inversion in the pump.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
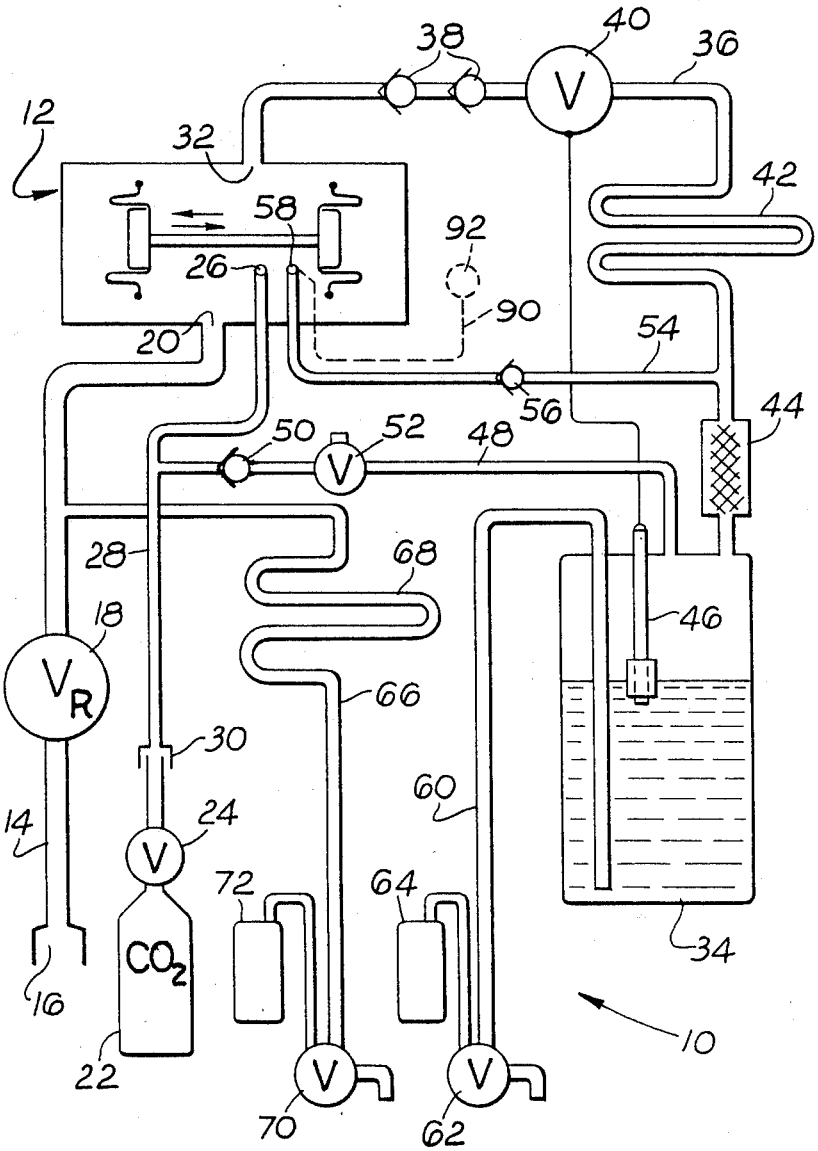
FIG. 1 is a fluid schematic of the preferred embodiment of the apparatus of the present invention, with which the method of the present invention may be practiced.

The present invention is particularly useful when embodied in an apparatus for making and dispensing carbonated water as is shown in FIG. 1 and is generally indicated by the numeral 10. The apparatus 10 is a pnuematically powered system for making and dispensing carbonated water and soft drinks, and it utilizes a double diaphragm continous delivery reciprocating liquid pump 12 to pump water.

The apparatus 10 has a water supply line 14 having an inlet connector 16 for being connected to an automatic bulk water source with an unknown and unpredictable water pressure; it could be high, could be low and typically will vary considerably during a day. Typical examples of an automatic water source will be municipal water systems, private well and pump systems, large building water systems, and water systems in factories, offices, stores and so forth. A relatively high flow water pressure regulator 18 is installed in the water supply line 14 and is preset at a factory to provide a predetermined water supply pressure of 25 PSIG (172 kPa) to a water inlet 20 of the pump 12. If source water pressure is higher than 25 PSIG, it will be brought down to 25 PSIG and if it is below 25 PSIG, the lower pressure will be passed through the regulator 18 and provided at the water inlet 20. A preferred water pressure regulator is available from Watts Regulator Co., Lawrence, Mass. A carbon dioxide bottle 22 provides $CO_2$ gas through a gas pressure regulator 24. The output pressure of the regulator 24 is preset to 85 PSIG (585 kPa) and this is the propellent pressure supplied to propellent gas inlet 26 of the pump 12 via a first gas line 28. The first gas line 28 has a connector 30 enabling the apparatus 10 to be connected to an external gas regulator 24 mounted on a remote $CO_2$ bottle 22 or alternatively the regulator 24 may be downstream of the connector 30 and be in the apparatus 10.

The pump 12 has its water outlet 32 fluidly connected to a carbonator vessel 34 by a water fill line 36. The fill line 36 has check valves 38 for preventing reverse flow, a normally closed water fill valve 40 for control of water flow therethrough, a heat exchange coil 42 for cooling of water to about 32 degrees F. (0 degrees C.), and a turbulator 44 for violently agitating and mixing the cooled water and $Co_2$ gas flow. The carbonator 34 has a level sensing control 46 which is operatively connected to the fill valve 40. The control 46 and fill valve 40 may be a float and NC solenoid valve, a float and a needle valve, or an electrical level sensor and a solenoid valve, or some other commonly used device. Another carbon dioxide gas line 48 through a discrete check valve 50 has a discrete pressure regulator 52 which is pre-set at the factory to have an output pressure of 30 PSIG (240 k Pa). The regulator 52 is a self relieving device and is downstream in the gas line 48 from the check valve 50 and any excessive pressure beyond the set pressure of 30 PSIG in the carbonator 34, for example 3 PSIG or greater (20 k Pa) will be vented out of the regulator 52 so that the pressure in the carbonator 34 is kept at a nominal 5 PSIG (35 k Pa) greater than the regulated water supply pressure. The second carbon dioxide gas line 48 is preferably connected to the first carbon dioxide gas line 28 between the connector 30 and the pump 12.

A $CO_2$ exhaust gas line 54 having a check valve 56 for preventing reverse flow, leads from a gas exhaust outlet 58 of the pump 12 to the water fill line 36 in between the heat exchanger 42 and the turbulator 44. When the pump 12 is operating, used propellent $CO_2$ and cooled pumped water are concurrently run through the turbulator 44 for carbonation of the water, and the used propellent $CO_2$ is again used for carbonation of the water. A carbonated water dispensing line 60 leads from the carbonator 34 to a dispensing valve 62, which is also connected to a supply of a first beverage syrup 64 which may be a cola.

A flat water dispensing line 66 is taken off of the water supply line 14 in between the water pressure regulator 18 and the pump 12 so that flat water is always under a 25 PSIG (172 k Pa) constant pressure. The flat water line 66 has a heat exchange coil 68 which is in a common heat sink (not shown) with the other heat exchange 42, and is connected to a second dispensing valve 70 which is also connected to a second source of beverage syrup 72. The constant and pre-determined water pressure in the flat water line 66 makes it very easy to accurately control the water flow rate during dispensing of a secondary flat or low carbonation beverage.

The pump 12, as previously mentioned, is a double diaphragm type pnuematically powered reciprocating pump 12, having a central connecting rod 80, a pair of pistons 82, and diaphragm 84. As shown in detail in FIG. 2, the liquid or pumping chamber 86 is on the outer end and the gas or propellent chamber 88 is on the inner end. Most of the double diaphragm pumps are built this way, but the Shurflow pump and a few others are reversed and have the liquid chambers in the middle and the propellent chambers on the outside. Either will work in this apparatus 10 and in this method.

Figure 2:
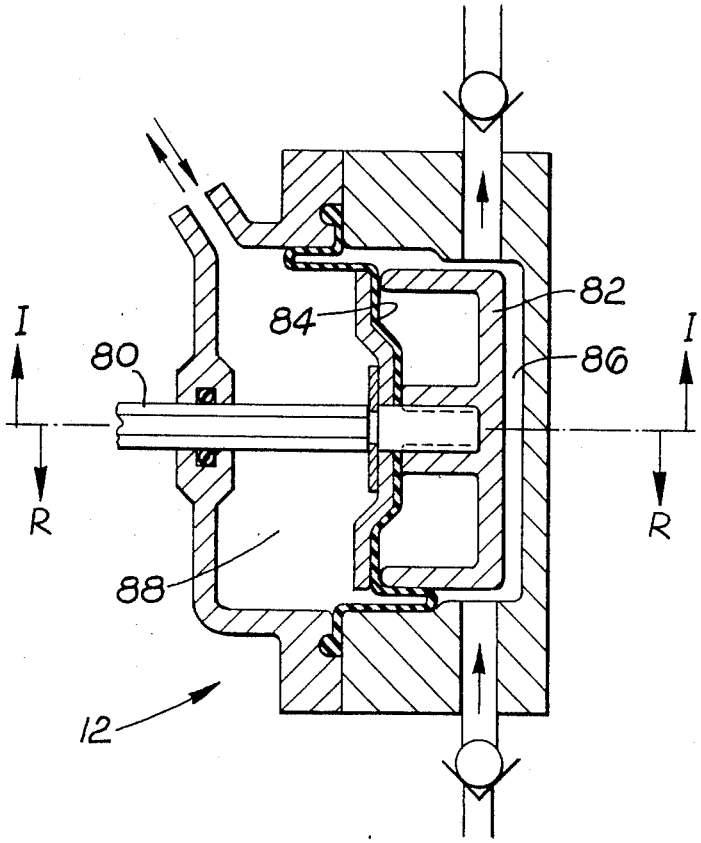
FIG. 2 is an elevational sectioned view taken through one cylinder of a double diaphragm pump utilized in the present invention.

The reason that these double diaphragm pumps have never worked as a water pump is graphically depicted in FIG. 2. Lower side R shows the normal position of the diaphragm 84 wherein the propellent pressure forces and always biases the diaphragm 84 into the liquid chamber. During pressurization of the propellent chamber 88, the diaphragm 84 is always in its normal position as shown on Side R. During filling of the liquid chamber 86, the chamber 86 is normally at a partial vacuum as it sucks syrup or other liquid and this partial vacuum keeps the diaphragm properly positioned as shown in R side.

However, if the pump 12 has been connected to a source of pressurized water, when the propellent chamber 88 has been opened to atmosphere via the pump control valve and the liquid chamber has been under the source water pressure, the source water pressure has inverted the diaphragm 84 and forced it into the propellent chamber 88 as is graphically depicted in Side I of FIG. 2 wherein the diaphragm 84 is shown in a state of inversion. This inversion/reversion/inversion/reversion occurs every cycle and the diaphragms 84 have failed extremely fast, with a great mess as a consequence.

In the operation of the apparatus 10 and in the practice of the method of the present invention, the source water pressure is regulated downward to a pre-determined regulated pressure (25 PSIG or 172 k Pa) which is below the carbonator storage pressure (30 PSIG or 206 k Pa). The carbon dioxide exhaust of the water pump 12 is sent into the carbonator 34 and there is an exhaust back pressure which is always higher than the regulated water supply pressure and therefore both diaphragms 84 are always under a propellent pressure which is greater than the water supply pressure. Specifically, when pumping, the diaphragm 84 is under 85 PSIG (585 k Pa) propellent pressure and when refilling the diaphragm 84 is under 30 PSIG (206 k Pa) exhaust back pressure. This is what prevents the diaphragms 84 from inverting and this is what now enables the use of these relatively low cost and highly efficient reliable double diaphragm pumps 12 as water pumps in carbonated water systems. This apparatus 10 and method use less carbon dioxide gas than the prior system of U.S. Pat. No. 4,304,736 because the diaphragms 84 are essentially free of friction and the friction losses of piston rings do not have to be overcome. The propellent pressure in the gas line 28 is significantly less than the propellent pressure needed by the device of U.S. Pat. No. 4,304,736 and therefore the structure of the pump 12 may be smaller and less costly.

If the consumption and usage of $CO_2$ becomes undesirable or objectionable, the apparatus 10 can be powered by compressed air with alternative pneumatic lines. The gas line 48 will now be discretely connected to $CO_2$ and have a regulated 30 PSIG (206 k Pa) output and preferably be connected into the fill line 36 upstream of the turbulator 44. The propellent gas line 28 will be connected to a source of compressed air (not shown) and be provided with compressed air at the same 85 PSIG. An alternative propellent exhaust line 90 will be connected to a pressure relief valve 92 which vents to atmosphere at a pressure of 30 PSIG (206 k Pa) which is always greater than the regulated water supply pressure, so that an exhaust back pressure is maintained in the propellent chamber 88 during filling of the pump liquid chambers 86.

The compressed air exhaust back pressure which is affected by the relief valve 92 may be higher or lower than the carbonation pressure in the carbonator vessel 34, but the water regulator 18 always provides a water supply pressure into the pump 12 and upon the diaphragm 84 which is less than the propellent exhaust back pressure so that the higher exhaust gas back pressure on the diaphragms prevents diaphragm inversion during cylinder filling.

The beverage apparatus 10 and method contain a new and improved method of an apparatus for boosting water pressure. The line source water pressure (P1) is dropped or reduced to a water supply pressure (Pws) which is always less than a propellent exhaust back pressure (Pe). The pneumatic propellent pressure (Pp) in propellent gas line 28 will usually be higher than the water source pressure and higher than the water supply pressure (Pws). The pump output or boosted water pressure (Pwb) will at its maximum approach the propellent pressure. This new apparatus 10 and method function according to the algorithim $$Pwb\ max = Pp - Pe + Pws$$

wherein the regulator 52 or relief valve 92 always keep the exhaust gas back pressure (Pe) greater than the water supply pressure (Pws) from the water pressure regulator 18 for preventing inversion of the pump diaphragm 84 during filling of the liquid chamber 86. The boosted pressure (Pwb) will fall some as the flow increases but upon closing of the fill valve 40, (which can be an outlet valve), the boosted pressure will reach its maximum valve in a static condition. The line source water pressure (P1) is reduced or dropped by the water regulator 18 to the lesser supply pressure (Pws). Pws and Pe are preferably pre-set fix constant valves with Pws being less than a carbonation saturation pressure giving 4.5 volumes of carbonation at 40 degrees F. (3 degrees C.), if and when the booster apparatus and method are used in a carbonated water system.

This a breakthrough enabling the usage of low cost and high efficiency and reliability double diaphragm pneumatic pumps as water pumps in carbonation system. This enables replacement of piston type pumps or electric motor driven pumps with a lesser cost and more efficient diaphragm pump. The pumping capacity has also been significantly increased due to the effective and efficient application of pneumatic power. This type of an apparatus 10 and method can now be used with ice cooling where electricity is not available.

This new booster system enables low cost replacement of Procon type or other electric water pumps and enables the manufacture of lesser cost and higher reliability carbonation systems.

Although other advantages may be found and realized, and various and minor modifications suggested by those versed in the art, be it understood that I wish to embody within the scope of the patent warranted hereon, all such enbodiments as reasonably and properly come within the scope of my contribution to the art.

I claim as my invention:

1. A method of pnuematically making and dispensing carbonated water comprising the steps of:

(a) connecting a double diaphragm continuous delivery pneumatic liquid pump to an automatic bulk water source;

(b) regulating a carbonation pressure within a carbonator vessel;

(c) providing a propellent gas pressure to the liquid pump, said propellent pressure being significantly higher than the carbonation presure;

(d) pumping water to the carbonator vessel with the propellent pressure;

(e) backing up used propellent gas in a pump exhaust and maintaining a gas back pressure in the pump exhaust and upon the diaphragms of the pump;

(f) dropping the water source pressure to a water supply pressure at the pump liquid inlet, said water supply pressure being less than the exhaust back pressure; and (g) preventing diaphragm inversion in the pump by always keeping a gas pressure on the diaphragm which is higher than the water supply pressure.

2. A method according to claim 1, wherein the pump is connected to an automatic bulk water source having variable and unpredictable pressures.

3. A method according to claim 1, including the further steps of cooling the water between the pump and the carbonator vessel, and regulating the supply water pressure to 25 PSIG or less and the carbonator vessel carbon dioxide pressure to 30 PSIG or more.

4. A method according to claim 1, in which a carbonator storage pressure is at least 5 PSIG greater than the regulated water supply pressure.

5. A method according to claim 1, in which the propellent gas is carbon dioxide.

6. A method according to claim 5, in which the used propellent carbon dioxide gas is exhausted into the carbonator vessel.

7. A method according to claim 1, including the further step of dispensing non-carbonated water taken out of the pressure regulated water supply upstream of the pump.

8. A method of pneumatically making and dispensing carbonated water, comprising the steps of:

(a) connecting a double diaphragm continuous delivery liquid pump to an automatic bulk water source at whatever pressure the source may be at;

(b) dropping the source pressure to a pre-determined supply pressure and providing only the supply pressure to a liquid inlet of the pump;

(c) pressurizing a carbonator vessel with carbon dioxide gas at a storage pressure which is higher than the supply pressure;

(d) providing propellent gas to the pump at a propellent pressure which is greater than either the supply or storage pressure and which is relatively constant regardless of the source pressure;

(e) filling the carbonator vessel by boosting the water pressure in the pump and in a fill line to the carbonator to a filling pressure which is higher than the storage pressure and which is approaching the propellent pressure, and opening a fill valve to the carbonator to allow a filling flow; and (f) preventing inversion of the diaphragm in the pump by always (1) keeping the propellent pressure on one of the diaphragms, and (2) keeping the storage pressure on the second diaphragm, so that both diaphragms always have a gas pressure thereon which always exceeds the water supply pressure.

9. The method of claim 8, including the step of dispensing flat water at the cropped pressure, before the pressure on the flat water is boosted.

10. The method of claim 8, in which the propellent gas is carbon dioxide, and including the further steps of exhausting all used propellent carbon dioxide gas to the carbonator, and keeping the gas pressure on the diaphragms higher by backing up the carbonator storage pressure into the pump and against the diaphragms.

11. Pneumatically powerable apparatus for making and dispensing carbonated water, comprising:

(a) a carbonator vessel having a water inlet, a water level control and a water outlet connected to a dispensing valve;

(b) a continuous delivery pneumatically powerable double diaphragm type liquid pump having a liquid outlet connected by a water fill line to the carbonator water inlet, and a liquid supply inlet connected to a water supply line;

(c) a water pressure regulator in the water supply line, said pressure regulator having an output pressure set at a pre-determined water supply pressure;

(d) a carbonator fill valve in the water fill line, said fill valve being operatively connected to the level control for control thereby;

(e) a first carbon dioxide gas line fluidly connected into the carbonator vessel, said first line having a first gas pressure regulator set at a pre-determined storage pressure which is higher than the water supply pressure;

(f) a second carbon dioxide gas line connected to a propellent inlet of the pump, said second line being connectible to means for supplying carbon dioxide gas at a regulated propellent pressure higher than the storage pressure; and (g) means for maintaining a gas pressure higher than the water supply pressure on the pump diaphragm at all times during exhaust of used propellent gas from the pump.

12. The apparatus of claim 11, in which said gas line has its inlet end fluidly connected into the second gas line.

13. The apparatus of claim 11, including a flat water line leading from the water supply line to a second dispensing valve, said flat water line being connected into the supply line in between the pump and the water pressure regulator.

14. The apparatus of claim 13, including a discrete heat exchanger in and for the flat water line, and a discrete heat exchanger in the water fill line, said exchangers being in a common heat sink.

15. Pneumatically powerable apparatus for making and dispensing carbonated water, comprising:

(a) a carbonator vessel having a water inlet, a water level control, and a water outlet connected to a dispensing valve;

(b) a continuous delivery pneumatically powerable double diaphragm type liquid pump having a liquid outlet connected by a water fill line to the carbonator water inlet, and a liquid supply inlet connected to a water supply line having means for being connected to an automatic bulk water source;

(c) means in the water supply line for reducing an undetermined water source pressure down to a pre-determined water supply pressure to and for the pump liquid inlet;

(d) means in the water fill line and connected to the carbonator level control for control of water flow from the pump to the carbonator; and (e) a carbon dioxide gas system having (1) a first gas line fluidly connected into the carbonator vessel, said line having therein means for regulating a carbon dioxide supply pressure in the carbonator vessel at a pressure which is higher than the water supply pressure, (2) a second gas line connected to a propellent inlet of the pump, said second line being connectible to means for supplying carbon dioxide gas at a regulated pressure substantially higher than the storage pressure, and (3) an exhaust gas line fluidly connected from a gas exhaust of the pump to the carbonator vessel.

16. A pneumatically powerable apparatus for making and dispensing carbonated water, comprising:

(a) a water supply line connectible to an automatic bulk water source at an undetermined water pressure;

(b) means in said supply line for reducing the source water pressure to less than a pre-determined carbonation pressure;

(c) a double diaphragm type liquid pump having a liquid inlet fluidly connected to said pressure reducing means and a liquid outlet connected to a carbonator vessel;

(d) a compressed gas propellent line connected to a propellent inlet of the pump, said propellent line having means for supplying propellent gas at a pressure higher than a carbonation pressure; and (e) means for applying the carbonation pressure upon the diaphragms of the pump, so that both diaphragms are always under a gas pressure which is greater than the water supply pressure, for preventing inversion of the diaphragms.

17. A method of boosting water pressure and supplying quantities of water at the boosted pressure, comprising the steps of:

(a) connecting a double diaphragm continuous delivery pneumatically powerable liquid pump to an automatic bulk water source;

(b) providing pressurized propellent gas alternately to each diaphragm of the pump, said propelled gas being at a propellent pressure which is substantially higher than the water source pressure;

(c) boosting the water pressure to close to the propellent pressure by pumping the water through and from the pump under the propellent pressure;

(d) exhausting used propellent gas from the pump and backing up the exhausted gas at an exhaust back pressure which is higher than the water source pressure, (e) maintaining the exhaust pressure alternately upon that diaphragm which is not being exposed to the propellent pressure during refill of the pump, and (f) preventing inversion of the diaphragm by always keeping on the diaphragm a gas pressure which is higher than the supply pressure to which the diaphragm is exposed during refilling.

18. The method of claim 17, (a) including the steps of pumping the water into a carbonator, (b) maintaining the exhaust back pressure at the carbonator pressure, and (c) reducing the water source pressure to a water supply pressure into the pump which is less than the carbonator pressure.

19. A method of boosting water pressure and supplying quantities of water at the boosted pressure with a double diaphragm continuous delivery pneumatically powered liquid pump, comprising the steps of:

providing and controlling the
water supply pressure (Pws)
water boosted pressure (Pwb),
pneumatic propellent pressure (Pp), and the
propellent exhaust back pressure (Pe),
according to the algorithm $$Pwb_{max}=Pp-Pe+Pws,$$

by maintaining Pe greater than Pws with control means connected to a propellent gas exhaust from the pump and to a water supply line into the pump, for controlling the valves of Pe and Pws respectively, and thereby preventing inversion of the diaphragms in the pump while reciprocating the diaphragm in the pump and pumping water at up to $Pwb_{max}$.

20. A method according to claim 19, including the further steps of connecting the pump water inlet to an automatic bulk water source having a line pressure of $P_1$, wherein $P_1$ is greater than $P_{ws}$, and including the further step of reducing $P_1$ to $P_{ws}$.

21. A method according to claim 20, wherein $P_{ws}$ is less than the carbonation saturation pressure of carbonated water having 4.5 volume of carbon dioxide at 40 degrees F.

22. A method according to claim 19, in which $P_{ws}$ and $P_e$ are pre-determined and pre-set constants.

23. Apparatus for boosting water pressure and continuously pumping water at the boosted pressure, comprising (a) a double diaphragm pneumatically powerable continuous delivery liquid pump having a liquid inlet, a liquid outlet, a propellent gas inlet and a propellent gas outlet;

(b) means for providing water to the liquid inlet at a pre-determined maximum water supply pressure;

(c) means for backing up used propellent gas in the gas outlet at a pre-determined minimum exhaust back pressure, said exhaust back pressure being higher than said water supply pressure; and (d) means for providing propellent gas into the gas inlet at a propellent pressure which is significantly higher than the exhaust back pressure.

24. Apparatus according to claim 23, in which said water providing means is a water pressure regulator having a constant output pressure, said regulator being connected to an automatic bulk water source.

25. Apparatus according to claim 23, in which said backing up means comprises a vessel for containing previously boosted water, said pump liquid outlet being connected to said vessel.

26. A pneumatically powered water pressure boosting apparatus (a) operatively defined by the algorithm $$Pwb_{max}=P_p-P_e+P_{ws},$$

wherein:

$P_{wb}$=boosted water pressure, out of the pump,
$P_p$=pneumatic propellent pressure into the pump,
$P_e$=propellent exhaust back pressure at the pump,
$P_{ws}$=water supply pressure at the pump; and having (b) a double diaphragm continuous delivery pneumatically powered liquid pump having a liquid inlet connectible to the water supply pressure, a liquid outlet for water at the boosted pressure, a gas inlet connectible to the propellent pressure, and a gas outlet subjectable to said exhaust back pressure;

(c) means connected to said gas outlet and said liquid inlet for maintaining $P_e$ greater than $P_{ws}$.

27. The apparatus of claim 26, wherein said means comprises (1) a water pressure regulator connected to the liquid inlet for regulating $P_{ws}$, and (2) a gas pressure regulator fluidly connected to the gas outlet, for regulating $P_e$

28. The apparatus of claim 27, including means connected into the water supply between the pump and the water pressure regulator, for discrete draw of water at $P_{ws}$.

29. The apparatus of claim 26, in which the liquid outlet is fluidly connected to at least part of said means.

* * * * *